US006378265B1

(12) United States Patent
Konstandt

(10) Patent No.: US 6,378,265 B1
(45) Date of Patent: Apr. 30, 2002

(54) SPACE FRAME CONSTRUCTION ASSEMBLY

(76) Inventor: Matias Konstandt, Parana 902, 1636 La Lucila Buenos Aires (AR)

( * ) Notice: Subject to any disclaimer, the term of this patent is extended or adjusted under 35 U.S.C. 154(b) by 0 days.

(21) Appl. No.: 09/488,226

(22) Filed: Jan. 20, 2000

Related U.S. Application Data

(60) Provisional application No. 60/122,118, filed on Mar. 1, 1999.

(51) Int. Cl.[7] ..... E04H 12/00

(52) U.S. Cl. ..... 52/655.2; 403/171; 403/218

(58) Field of Search ..... 52/655.1, 655.2, 52/81.3; 403/171, 172, 176, 217, 218; 446/126

(56) References Cited

U.S. PATENT DOCUMENTS

| | | | | | |
|---|---|---|---|---|---|
| 4,905,443 | A | * | 3/1990 | Sutcliffe et al. | 52/655.2 |
| 4,932,808 | A | * | 6/1990 | Bär et al. | 52/655.2 |
| 5,074,094 | A | * | 12/1991 | Gassler | 52/655.2 |
| 5,074,700 | A | * | 12/1991 | Swoboda | 403/171 |
| 5,095,677 | A | * | 3/1992 | Godbout et al. | 52/655.2 |
| 5,318,470 | A | * | 6/1994 | Denny | 446/126 |

* cited by examiner

*Primary Examiner*—Michael Safavi
(74) *Attorney, Agent, or Firm*—Malloy & Malloy, P.A.

(57) ABSTRACT

A space frame assembly designed for use in the constructing of a variety of substantially rigid, weight bearing structures including but not limited to walls, bridges, roof structures etc. The space frame assembly comprises a plurality of elongated preferably tubular frame members formed of a high strength, light weight material having opposite end portions formed to include an anchor portion thereon. Each of said plurality of connectors includes a base and at least one end portion mounted thereon such that correspondingly positioned interior surfaces of the base and end portion are disposed in confronting relation to one anther and wherein the base and the one end portion each include a plurality of sockets disposed in spaced and off-set relation to one another. Each of the plurality of sockets includes an elongated curvilinear groove integrally formed therein and disposed in aligned cooperative relation to one or more recesses formed in the aforementioned interior surface of the interconnected base or cover portion. The grooves and recesses are disposed, dimensioned and configured to receive and grip the anchor portions on any one of the ends of any one of the frame members. Interconnection of a plurality of frame members by a plurality of connectors in an predetermined design or configuration will serve to form a support frame for any of the aforementioned substantially rigid, weight bearing structures of the type set forth above.

28 Claims, 10 Drawing Sheets

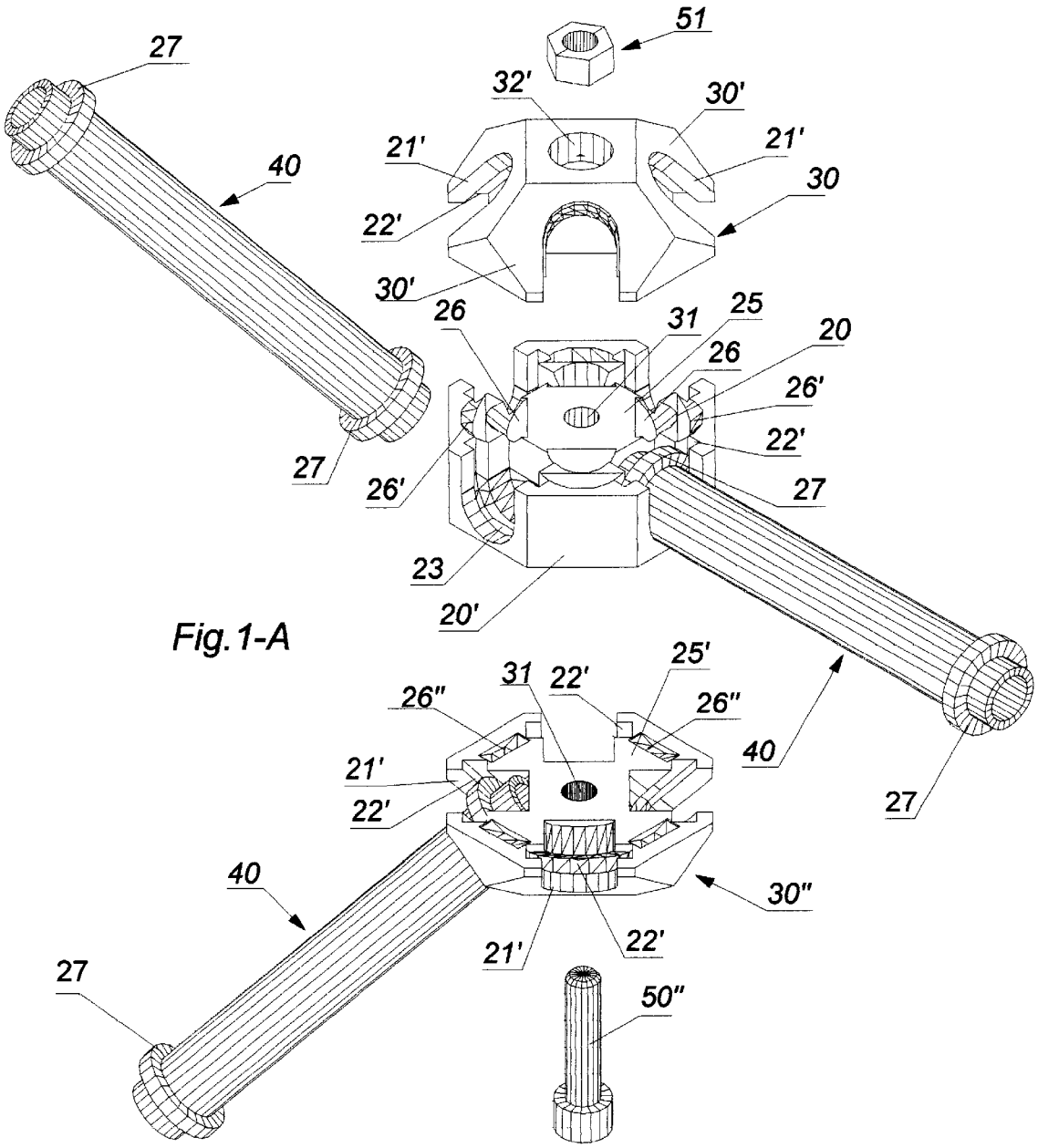
Fig. 1-A

SPACE FRAME CONSTRUCTION ASSEMBLY

CLAIM OF PRIORITY

The present application is based on and a claim to priority is made under 35 U.S.C. Section 119(e) to provisional patent application currently pending in the U.S. Patent and Trademark Office having Ser. No. 60/122,118 and a filing date of Mar. 1, 1999.

BACKGROUND OF THE INVENTION

1. Field of the Invention

This invention relates generally to a space frame assembly, and more in particular, to components which may be assembled to form a space frame assembly capable of defining a wide variety of structures having any one of numerous design configurations. The space frame assembly of the present invention preferably comprises a plurality of equivalently structured and elongated frame members interconnected by a plurality of equivalently structured connectors, and further, wherein any of the plurality of frame members may be interconnected in an intended configuration by any of the plurality of connectors in order to form a support frame which may be utilized in the construction of domestic or commercial buildings, bridges, platforms, hangers, towers, panels and other structures.

2. Description of the Related Art

The use of support frames or assemblies of the type referred to as "space frames" or "space framing" has been generally known and used in the construction of a variety of architectural and engineering structures. Certain recognized advantages of space frame construction include a substantially equal distribution of loads and stresses throughout the formed structure, as well as the ability to take advantage of the normally light-weight and high strength material from which such support frame assemblies are formed. In addition, the resulting structure offers a relatively unusual appearance although one which many deem to be aesthetically appealing. When a space frame support assembly is incorporated in the construction of various buildings or other structures, the above set forth characteristics are achieved through the use of a plurality of components, which in general, are used repetitively to achieve a triangulated geometry that is normally presented in a predetermined, three dimensional, reticulated, truss-like framework. The resulting framework is generally defined by a plurality of interconnected struts normally joined or attached to one another at appropriate points, and collectively arranged to produce the intended resulting structure. One advantage in utilizing such a repetitive framework is that the various components thereof may be mass produced in a factory, and then easily and relatively cheaply transported to a construction site where they are assembled. It has been recognized that the small size and light-weight material of the large number of components comprising the support framework simplifies transportation, and supposedly, handling and construction as well.

Space framing assemblies are particularly adaptable for roof coverings and walls in that the resulting structure is extremely rigid and has an exceptional ability to resist large, concentrated and/or symmetrical loads or stresses. In addition, framework of the type set forth above is hyperstatic, and accordingly, even when partially damaged, due to fire, explosion, earthquake or other natural disasters, seldom fails or collapses totally. This feature makes support frames comprised of space frame construction particularly desirable in areas where earthquakes, hurricanes, and like occurrences are prevalent.

In spite of the generally recognized advantages associated with space frame assemblies, the complexity of the various components used in forming the truss-like framework frequently results in relatively high manufacturing and assembling costs. Therefore, the complexity of the various components may significantly limit the use of such structures. For these reasons, truss-like space framing of the type referred to above is frequently limited to the construction of hangars, or other buildings and structures designed to enclose a large space, wherein the cost is closely regulated, due to the space framing acting as a skeleton for the structure. Also, space framing is known to be utilized in the construction of buildings, wherein the aesthetic and visual impact may be important and cost is a secondary consideration.

Generally speaking, there are two basic types of space frame construction previously developed and known in the art. The first type involves the attachment of each of a plurality of struts to a connecting component wherein the various struts are joined together repetitively by bolts or like fasteners. The connecting components are connected by and therefore include the same number of bolts or like fasteners as there are struts being interconnected. The second type involves forming a space frame assembly with the struts and connecting components in a two or three part sequence, wherein the entire connecting component is fastened to a corresponding strut by only a single bolt or like fastener. However, the problems exhibited by both of these known types of space frame assemblies are well recognized. More specifically, the connecting components utilized in forming the known types of space frame construction generally require the use of a large number of components, and may typically include four or more cruciform clamping elements which form the basis of the connecting components. This structural arrangement generally increases the manufacturing cost, and also, increases the possibility of errors being made in the calculations of the amount of material needed during manufacturing and the number of pieces needed during assembly.

In order to overcome the requirement of using a large number of fasteners with such known assemblies and connecting components, attempts have been made to incorporate threaded connections to secure the struts to the connecting components. However, a new set of problems arise when the struts are threadingly engaged with the connecting components at the point of attachment which does not typically occur when fasteners are used. This is due to the fact that the threads typically have fine tolerances, and when used by unskilled labor, the threads can be easily stripped, thereby rendering use of the connecting components impossible or even dangerous should they be forced into attachment with one another. In addition, the threading procedure is time consuming, and therefore, expensive considering the number of components involved in the formation of a given structure.

In a similar but somewhat different space frame assembly, connecting components have been developed which include the plurality of interconnected struts having ends which are either flattened or bent. More importantly, it is believed that there is a greater occurrence of failure in the extremities of the mechanically deformed end portions of the struts, based primarily on the fact that such mechanical deformation weakens the structural integrity of the entire framework.

In addition to the foregoing, others have attempted to improve space frame assemblies by using different kinds of materials for the various connecting components employed by the assembly. This sometimes results in the generation of galvanic corrosion between the parts formed of different materials, which also serves to weaken the entire structure over a period of time. The environment and geographic location, as well as the various weather systems, to which the building is exposed also have a significant effect on this type corrosive degeneration. Also, the close tolerance required in this type of construction has resulted in the interconnected joints having a tendency to fuse, due to the aforementioned galvanic corrosion after a period of time, particularly when subjected to a moist environment. This, in turn, makes the separation or detachment of individual connecting components for purposes of removal, repair or maintenance, extremely difficult, if not impossible. The replacement of such fused parts in an already completed structure, therefore, becomes both time consuming and expensive. Finally, because the construction of space frame assemblies has historically required that a very large number of small, connecting components and struts be interconnected, which is compounded given the highly repetitive nature of the intended geometric configuration, manufacturing of such components demands close tolerances. Accordingly, the vast majority of attempts to use space frame construction have produced overly complex designs resulting in laborious, time consuming assembly and manufacture of the various components involved, thereby increasing the resulting cost of construction to a degree which prohibits wide spread usage of space frame assemblies.

SUMMARY OF THE INVENTION

The present invention is directed towards a space frame assembly which is designed for wide spread use in that it can be utilized to construct, both efficiently and economically, a large variety of substantially rigid, weight and stress bearing structures, and particularly, those of the type incorporating a repetitive, three dimensional configuration.

More specifically, the space frame assembly of the present invention comprises a plurality of improved connecting components. In particular, the present invention includes a plurality of improved frame members, which are preferably both elongated, cylindrical and tubular in construction, having oppositely disposed ends. Each of the oppositely disposed, and preferably, open ends of each frame member includes an anchor portion which preferably, extends laterally outward from the cylindrical surface of the frame member. The anchor member, in a preferred embodiment to be described in greater detail hereinafter, is spaced at least minimally inward from the outer extremity on each end of the frame member, and includes a circular or annular configuration which is integrally formed on each of the ends, as set forth above. The space frame assembly of the present invention further comprises the interconnecting of individual ones of the plurality of frame members into a desired three dimensional configuration, wherein the primary "building block" of the space frame support assembly may be in the form of a pyramid, defined by a base having a square configuration and four sides each of which has a triangular configuration.

The space frame assembly of the present invention further comprises a plurality of improved connectors for interconnecting individual ones of the plurality of frame members. Each one of the improved connectors is preferably used to interconnect two or more of the frame members. Depending on the geometrical configuration of the intended structure being formed, each of the plurality of connectors may be attached concurrently to the ends of a significant number of such frame members, such as eight or more. Further, each of the plurality of connectors preferably includes a base having a sidewall that defines a multi-sided, exterior surface configuration, which most preferably, but not necessarily, is an octagonal configuration. More specifically, the exterior surface configuration of the base side wall may comprise a variety of multi-sided configurations other than octagonal and may even be spherical or at least partially spherical. The base also preferably includes a first plurality of sockets formed therein, in spaced relation to one another along the sidewall thereof. In addition, each of the plurality connectors includes at least one cover portion which is preferably attached to the base by a single bolt and receiving nut fastener. Preferably, the base and the at least one cover portion are joined together by the presence of the bolt and nut fastener such that the correspondingly positioned interior surfaces of the base and the cover portion are secured in confronting engagement with one another.

The at least one cover portion for the base of the connector also preferably includes a side wall having an exterior surface configuration being multi-sided or even spherical. In the preferred embodiment the exterior surface configuration is preferably but not necessarily, an octagonal configuration. Most preferably, the various faces or segments of the side wall of the at least one cover portion are all arranged at a common angular orientation relative to the side wall of the base. The one cover portion also preferably includes a second plurality of sockets disposed in spaced relation to one another and formed in the sidewall of the one cover portion. When joined, the first plurality of sockets formed in the base and the second plurality of sockets formed in the cover portion are preferably disposed in spaced, off-set relation to one another, and further, are each sized and configured to snugly receive an end of one of the plurality of frame members therein. In the most preferred embodiment, each of the first and second plurality sockets of each base and each cover portion, respectively, are internally structured and configured to include an elongated groove, which is specifically dimensioned, configured and oriented to receive, in a gripping fashion, at least a majority of the anchor portion formed on each end of the plurality of frame members. When so positioned, the frame members extend outwardly from the plane of the sidewall segment to which they are attached. In addition, each of the plurality of sockets of both the base and cover portion of each connector includes an open end disposed in aligned, communicating relation with the interior surface of a corresponding cover portion and base, respectively. As such, the anchor portion formed on each end of the plurality of frame members is disposed to be received by the elongated groove comprising a portion of the interior surface configuration of any one of the first and second plurality of sockets in which they are mounted. In order to further achieve a firm gripping of the anchor portion of a frame member, the base and cover portion include at least one recess formed in the respective interior surfaces thereof. Each of such recesses is disposed in aligned relation to a correspondingly positioned one of the first or second plurality of sockets, so that secure, fixed and adequately supported gripping of either end portion of each of the frame members may be established.

One feature of the present invention is the design and structure of each of the plurality of the connectors, which allows a frame member to be maintained in a preferred "pre-set" orientation within an intended socket in a manner which will assure proper alignment of the frame members, relative to the connectors, prior to fixedly attaching the base to the one end portion through a fixed securement of the bolt and nut fastener. This greatly facilitates the assembly of any intended structure, since an accurate "pre-set" positioning of the frame members relative to the connectors is accomplished without requiring excessive handling or manipulation by the installing personnel.

In another preferred embodiment of the present invention, each or a predetermined number of the connectors may include a second cover portion secured to an opposite side of the base. In this alternative embodiment, the base is specifically structured to include oppositely disposed interior surfaces adaptable for confronting engagement with separate, spaced apart but interconnected cover portions, which may be attached to define the opposite ends of the connector. By virtue of the base being capable of interconnection with a plurality of cover portions, such as two cover portions, a greater number of the frame members may be attached to any connector, thereby greatly enhancing the versatility of three dimensional geometrical formations which may be established through the utilization of the space frame assembly of the present invention.

In the manufacturing of the various components of the space frame assembly of the present invention, the cover portions associated with each connector are preferably, identically structured, and accordingly, can be either formed by known casting or forging techniques using a single mold. Similarly, the base of the connector is preferably equivalently structured for all of such plurality of connectors, and as such, a second mold conforming to the base can be utilized in the casting or forging process. The forming of the anchor portion on each of the two opposite ends of each of the plurality of frame members can be formed preferably by conventional stamping techniques utilizing well-known, tube forming machines. In addition, each of the connectors and plurality of frame members can be formed from a variety of materials, depending upon the intended use and weight bearing capacity of the structure being constructed, further providing that all the components used in the formation of a single structure are preferably formed of the same material. Such materials may be metallic, such as, but not limited to steel or aluminum, or other materials such as plastics or composite materials, which may be specifically molded or otherwise manufactured to accomplish the intended purpose.

Therefore, the space frame assembly of the present invention is simplified by the improved design of the connectors and frame members, which can be easily interconnected, and further, disassembled, if that should be needed or desired. The fact that interconnection of a plurality of frame members by a single connector with preferably the use of only a single bolt and nut or related fastener structure is also a distinct advantage. Once the space frame assembly of the present invention has been completed, the outer surface thereof can be covered by "skin" defined by panels utilizing somewhat conventional clips or fasteners to interconnect the panels to the space frame assembly for completion of the intended architectural or engineering structure.

The space frame assembly of the present invention is capable of being used as a primary support frame for any of a wide variety of engineering and/or architectural structures, and is characterized by such structural features as substantial rigidity, significant weight bearing capabilities and light weight, open construction. In addition the space frame assembly comprises a plurality of improved connecting components which may be interconnected in a quick and efficient manner by semiskilled personnel to form an intended structure having any of a large variety of possible, three dimensional, geometrical design configurations.

Also the space frame assembly comprises a plurality of connecting components, all of which are preferably formed of a common, light-weight and yet, high strength material resistive to corrosion, and which may be readily interconnected to one another to form an intended structure, as well as detached from one another, at least in part, for purposes of repair and/or replacement. Further, the space frame assembly is designed to serve as an internal support frame for a wide variety of engineering and architectural structures, wherein the outer surface of such a support frame may be covered by panels or other desired components using conventional or specialized fasteners in defining an outer "skin" of the structure being constructed. The space frame assembly includes the additional feature of being formed of a minimal number of different components, wherein corresponding ones of such plurality of components are equivalently structured and capable of being economically manufactured, preferably in a generally small size, so as to also be capable of being economically transported from a site of manufacture to a site of assembly. Also, the space frame assembly which is capable of being used as a primary structural support, and which comprises a plurality of equivalently structured components which may be interconnected to one another into a desired three dimensional, geometrical configuration utilizing a minimum number of substantially conventional fasteners to fixedly interconnect corresponding ones of such components.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1A is an exploded isometric view of the various components of another embodiment of the space frame assembly of the present invention.

Like reference numerals refer to like parts throughout the several views of the drawings.

DETAILED DESCRIPTION OF THE PREFERRED EMBODIMENT

Figure 13:
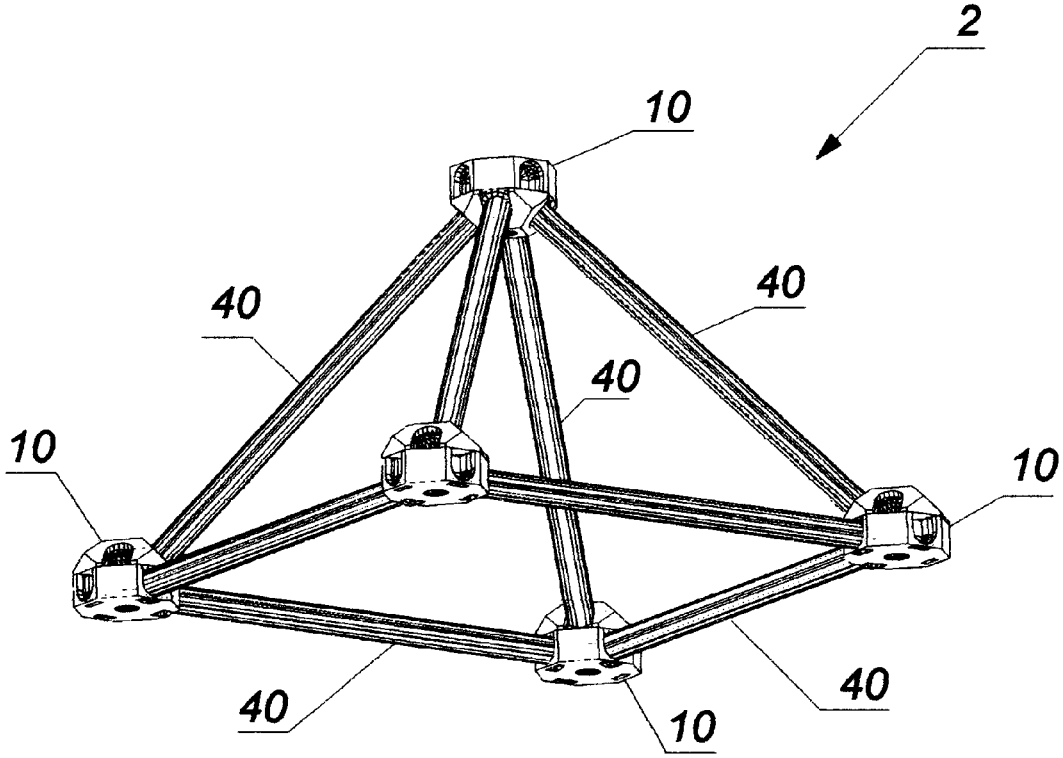
FIG. 13 is an isometric view of a plurality of the components of the embodiments of FIGS. 1 through 9 assembled into a pyramid configuration.

The present invention is directed to a space frame assembly, shown at least partially assembled in a pyramid configuration 2 of FIG. 13. Pyramid 2 may comprise at least one primary "building block" used in the construction of a variety of architectural and engineering structures. The resulting building, bridge, tower, scaffold or other structures which incorporates the space frame assembly of the present invention, would thereby, all have the common features of substantial rigidity, significant load, weight bearing and stress capabilities, and further, could be formed to have an extremely large variety of possible, three dimensional geometrical design configurations. More specifically, the space frame assembly of the present invention comprises a plurality of frame members 40, interconnected to one another by a plurality of connectors 10, so as to form an intended geometrical configuration which defines an intended structure, such as, but by no means limited to a bridge, as shown in FIG. 14-B or a variety of other structures, such as of the type shown in FIG. 14-A.

With initial reference to FIGS. 1 through 7, the improved connectors 10 of the present invention will now be described. As illustrated each of the plurality of connectors 10 includes a base 20 having a first interior surface 25 which may be at least partially planar and a side wall, which preferably comprises a plurality of multi-sided, side wall segments 20'. Further, in at least one embodiment the base 20 includes a generally octagonal side wall configuration, defined by eight of the side wall segments 20'. It should be emphasized, however, that a different configuration can be utilized, wherein the number of side wall segments 20' may vary. In addition, the base 20 includes a first plurality of sockets 21, which ideally, are disposed in spaced relation to one another, and further wherein the sockets 21 are integrally formed in alternate ones of the side walls segments 20'.

Each of the plurality of connectors 10 also includes at least one cover portion 30. The preferred cover portion 30 also includes an at least partially planar interior surface 25' and a side wall defined by a plurality of side wall segments 30'. While the exterior surface configuration of side wall segments 30' may be at least partially spherical, one embodiment of the present invention, is perhaps best illustrated in FIG. 4, comprises the side wall segments 30' arranged at an angular orientation relative to the central axis of the cover portion 30 as well as the side wall segments 20' of the base 20. Ideally, the angular orientation of the side wall segments 30' is substantially forty-five (45°) degrees. The specific angular orientation of each of the side wall segments 30' may vary, but preferably, would vary consistently throughout each of the connectors 10, as they should each be equivalently structured. The cover portion 30 also includes a second plurality of sockets, 21', which may also be integrally formed in the cover portion 30, and which extend into the interior of the cover portion 30 through the sidewall segments 30'. It is also to be emphasized that while this embodiment of the cover portions 30 comprises an exterior surface configuration having a multisided, octagonal shape, the exterior surface configuration could vary to include four sides, 6 sides or other multi-sides shape and could even assume the curved, spherical or at least partially spherical exterior surface configuration, as set forth above. Also, the number of spaced apart sockets 21 in base 20 and/or 21' in the cover portion 30 could vary and include six or more sockets.

Figure 1:
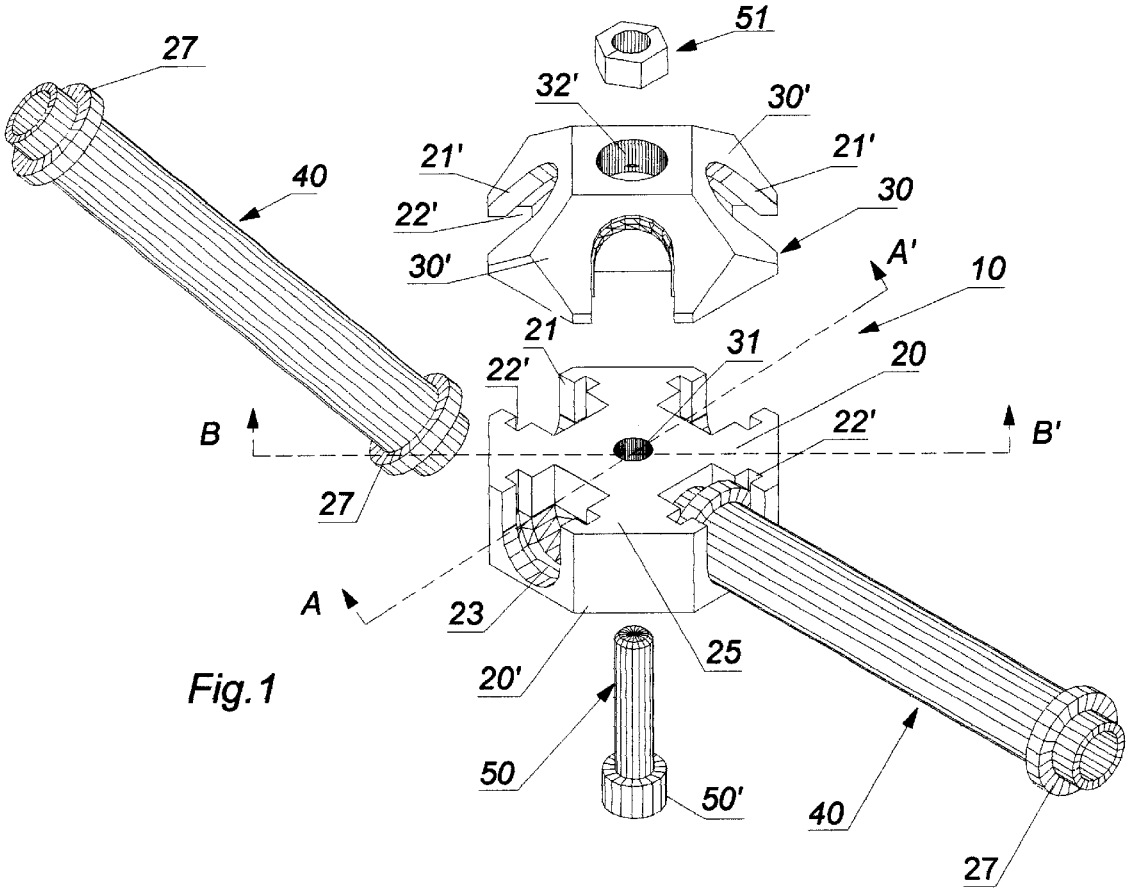
FIG. 1 is an exploded isometric view of the various components comprising the space frame assembly of the present invention.
Figure 2:
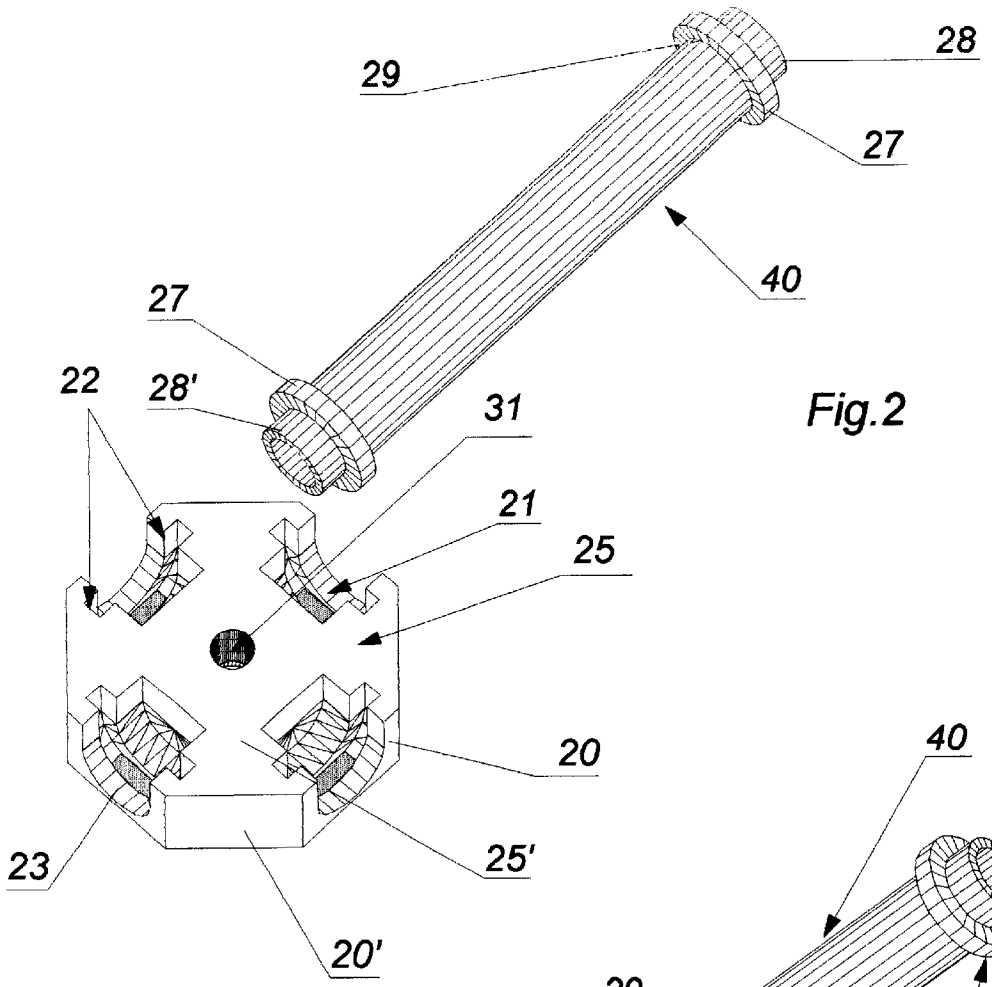
FIG. 2 is a top isometric view in exploded form of certain components of the embodiment of FIG. 1.
Figure 3:
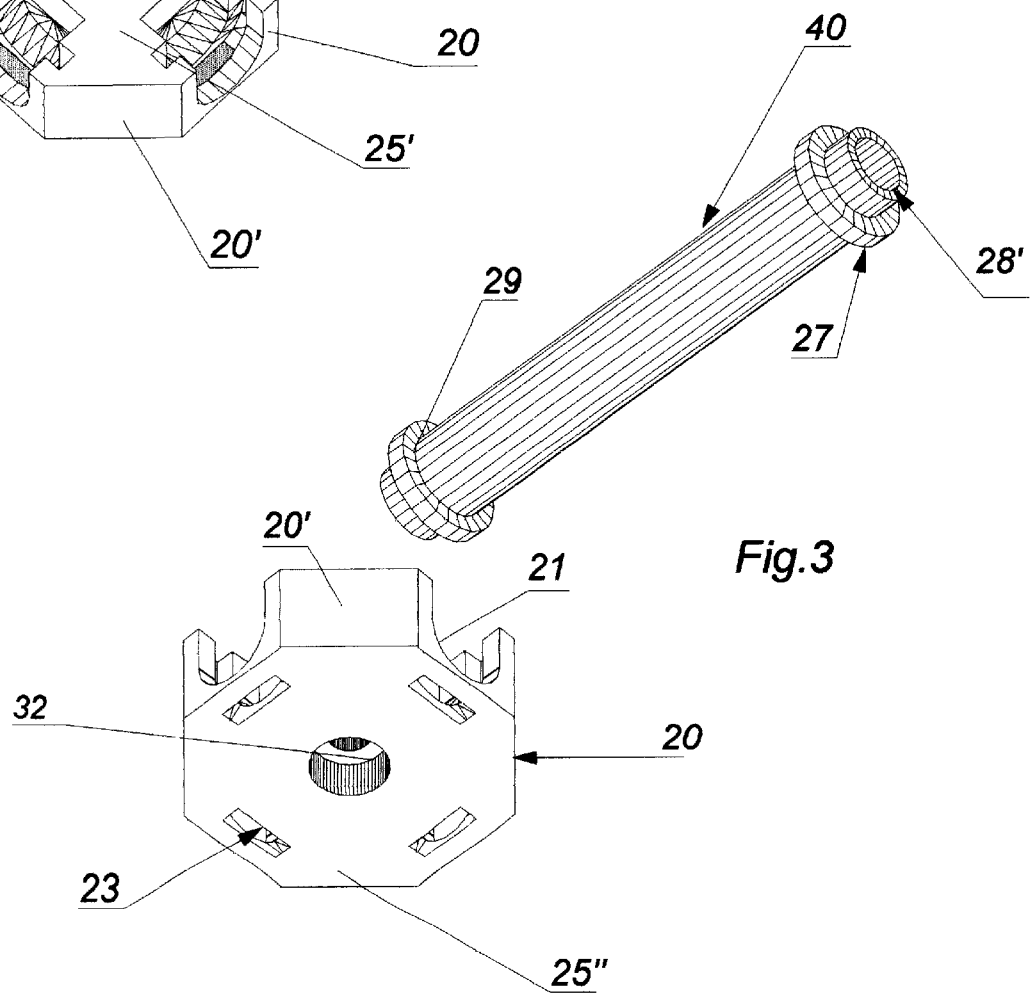
FIG. 3 is a bottom isometric view in exploded form of the embodiment of FIG. 2.
Figure 5:
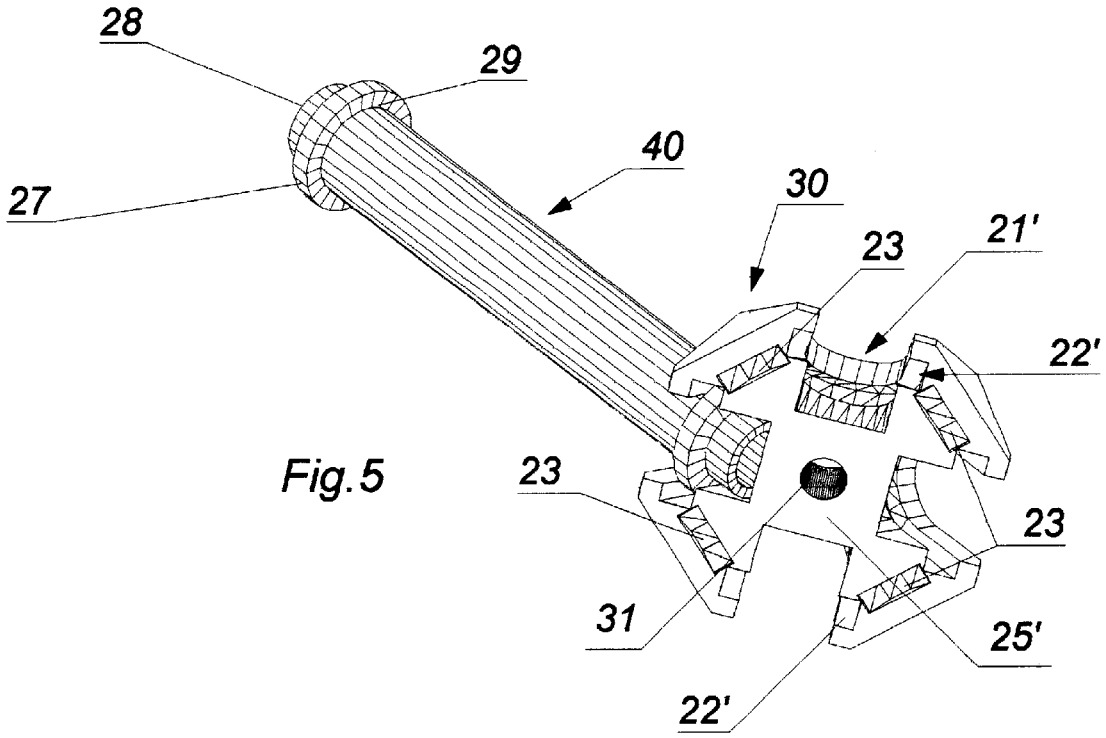
FIG. 5 is a bottom isometric view of the embodiment of FIG. 4.

It should be noted that the first and second plurality of sockets 21 and 21' are substantially equivalently structured with a distinction being, as set forth above, that the sockets 21' of the cover portion 30, are disposed at a preferred or predetermined angular orientation. Preferably, and as illustrated in FIGS. 1, 2 and 5, each of the first and second plurality of sockets 21 and 21' also includes an elongated groove 22, which may be integrally formed on the interior surface thereof, wherein each of the grooves 22 has an elongated, curvilinear and preferably a substantially "U" shaped configuration or an inverted "U" shaped configuration, as the case may be for the base and cover portion, respectively. Further, each of the grooves 22 preferably terminates at an open end, as at 22', see FIGS. 1 and 5, corresponding to the open end of each of the plurality of sockets 21 and 21'. In addition, the grooves 22 formed in each of the first plurality of sockets 21 of base 20 each include an aperture or window 23, as best shown in FIGS. 1 and 3. Aperture 23 is disposed and configured to allow a correspondingly positioned segment of an anchor portion 27, to be described subsequently herein, to protrude therethrough in order to assure a firm gripping engagement between the connector 10 and an end portion, 28, of a frame member 40.

In that the end of the frame members 40 are gripped within the grooves 22 of the cover portion 30 of the second plurality of sockets 21, it is a feature of the present invention that the orientation of the plane defined by such grooves 22 is at a preferred angular orientation of 45° when the length of the frame members 40 are equivalent. However, it is emphasized that the angular orientation of the plane of the groves 22 of the cover portion 30 may be oriented at a variety of other angles such as substantially between 45° and 33° at least partially dependent on the lengths of the frame members 40 connected to the cover portion 30. When the lengths of the frame members 40 are equal it is most preferred that the grooves 22 of the cover portion 30 are oriented at a substantially 45° angle, as set forth above. When the frame members 40 are not equal in length the angular orientation of grooves 22 of the cover portion 30 may vary preferably within the above indicated parameters. Therefore, correspondingly positioned grooves 22 within sockets 21' may or may not be disposed in parallel relation to side wall segments 30'.

Figure 6:
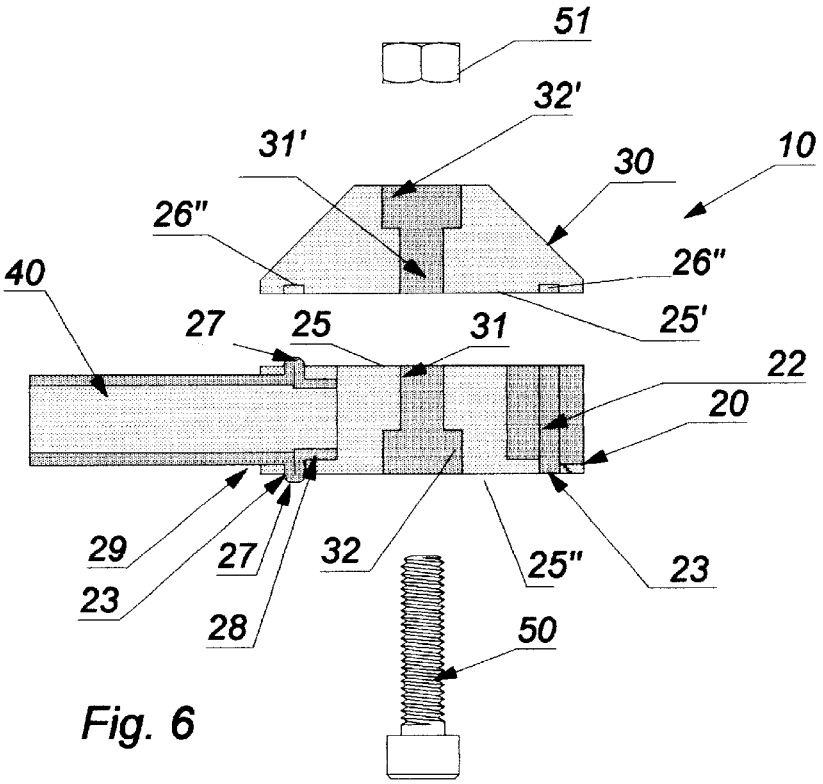
FIG. 6 is a sectional view in exploded form taken along line A—A of FIG. 1.
Figure 7:
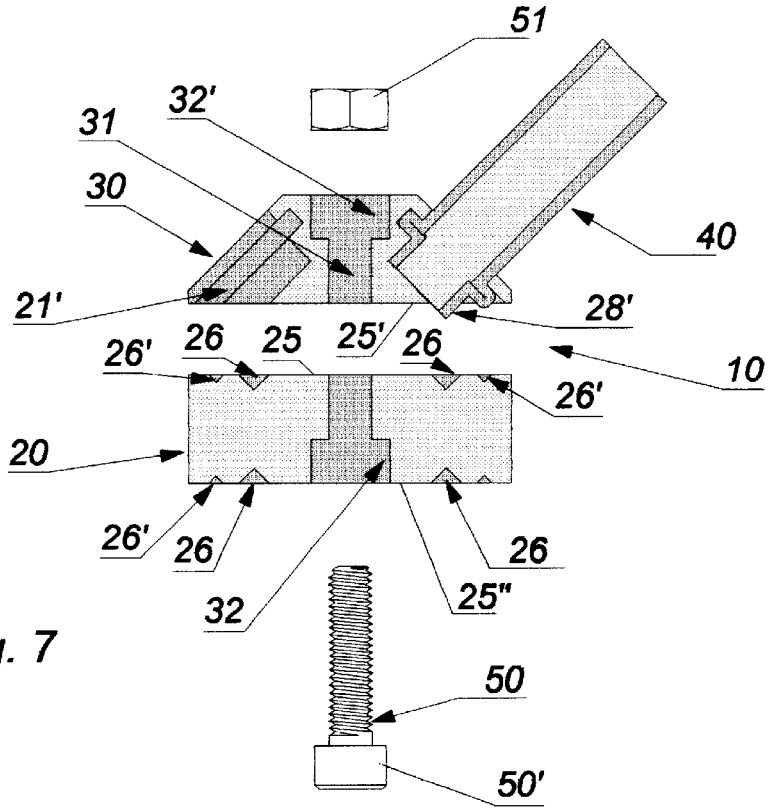
FIG. 7 is a sectional view in exploded form taken along line B—B of FIG. 1.
Figure 8:
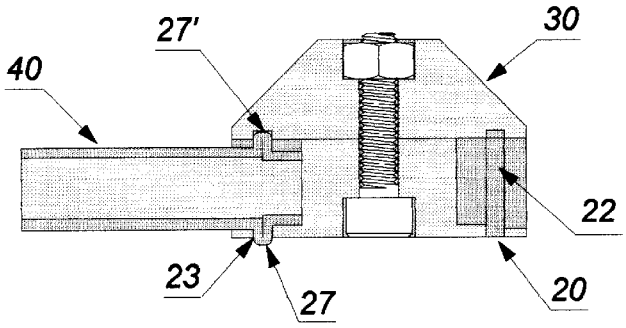
FIG. 8 is a sectional view in assembled form of certain components of the embodiment of FIG. 1.
Figure 9:
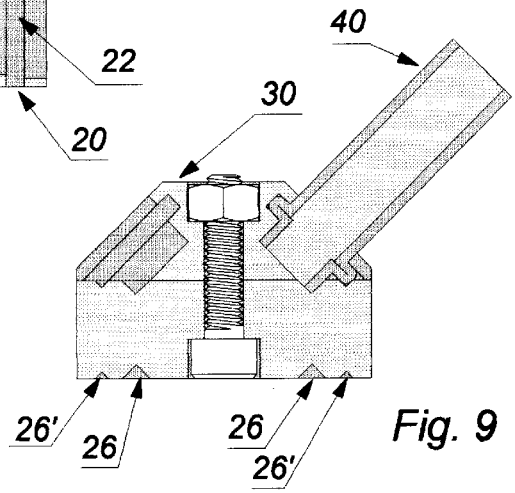
FIG. 9 is a sectional view in assembled form of certain components of the embodiment of FIG. 1.

With reference to FIGS. 6 and 7, other structural features of the preferably equivalently structured connectors 10 more preferably include the formation of a pair of recesses 26 and 26' in the first interior surface 25 of base 20, at locations thereon which are ideally disposed in aligned, direct communication with the open end 221 of the correspondingly positioned second plurality of sockets 21' in the cover portion 30. Similarly, in one embodiment, a plurality of recesses 26" are formed in the second interior surface 25' of the cover portion 30, which ideally, are disposed in aligned, communicating relation with correspondingly positioned ones of the first plurality of sockets 21 formed in base 20, by means of the open end of each of the plurality of sockets 21, as set forth above. The specific structure, dimension and configuration of the first and second plurality sockets 21 and 21', as well as the elongated grooves 22 and the plurality of recesses 26, 26' and 26' are collectively designed to correspond to and receive the end portions, generally indicated as 28, on each of the opposite ends of the plurality of frame members 40, as will be explained in greater detail hereinafter. It is to be noted that for purposes of clarity, the recesses 26, 26' and 26' are not shown in all the accompanying Figures.

Referring now to FIGS. 1, and 6 through 9, when the connector 10 is assembled to assume a fixedly connected position, the base 20 will preferably be secured to the at least one cover portion 30, by means of a single fastener structure, 50, preferably in the form of an elongated bolt or screw like member, and a connecting structure to the distal end thereof, such as a nut, 51. More specifically, the fastener 50 is preferably of sufficient length to extend co-linearly to the central axis of both the assembled base 20 and the one cover portion 30, and to be attached at its distal end, to the nut 51 in a conventional fashion. In order to facilitate attachment of the elongated fastener 50 and the nut 51 to the connector 10, apertures, as at 32 and 32', are preferably formed in the base 20 and the at least one cover portion 30, respectively, for receipt of the head 50' of the fastener 50 and the nut 51, respectively. It should be noted that the nut 51 may be initially detached and applied by personnel during the assembly of the base 20 and cover portion 30 or may be fixed within the aperture 32' during the manufacture of the cover portions 30 of the plurality of connectors 10.

As set forth above, the space frame assembly of the present invention further comprises a plurality of improved frame members 40. In the preferred embodiment, each of the frame members 40 is equivalently structured, and most preferably, each frame member 40 comprises an elongated, tubular configuration which is preferably, but not necessarily, of equal length and which terminates at oppositely disposed end portions, generally indicated as 28. Each of the frame members 40 preferably also includes an outer cylindrical surface 29 having a substantially common outer diameter along the entire length thereof, with the exception of the provision of anchor portions 27, shown in FIGS. 2 and 3, which will now be described. Specifically, it is preferred that each of the end portions 28 of each of the frame members 40 include an anchor portion 27 thereon, which may be stamped or otherwise mechanically formed in the manufacture of the frame member 40, to include outwardly projecting anchor portions 27 which are ideally positioned substantially adjacent the extremities 28' of the opposite end portions 28 and in inwardly spaced relation thereto. Of course, it is conceivable that an attachment member might be attached to the end portion 28 of the frame member 40 to form the anchor portion 27, which while not preferred, should still be considered to fall within the scope and spirit of the present invention. Also, in a most preferred embodiment, each of the anchor portions 27 are defined by a continuous, annular configuration extending outwardly from the cylindrical outer surface 29 an equal distance along the length of the respective anchor portions 27. Further, the anchor portions 27 are preferably spaced inwardly from the extremities 28' an equal distance.

Figure 4:
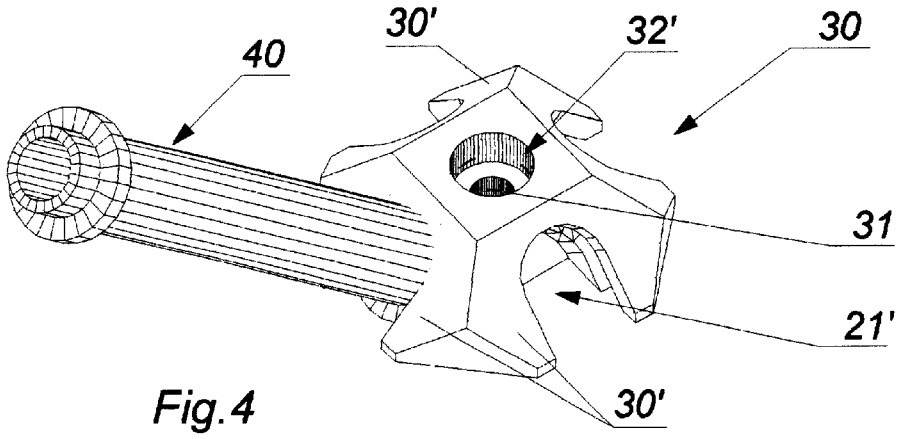
FIG. 4 is a top isometric view in assembled form of certain components of the embodiment of FIG. 1.

Due to the fact that each of the frame members 40 are identically structured in the preferred embodiment, and in particular, the structural configuration and dimension of the end portions 28 with the anchor portions 27 integrally formed thereon, such frame members 40 are interchangeable to the extent that any of the plurality of frame members 40 can be secured to and extend outwardly from any one of the plurality of connectors 10 comprising the base 20 and at least one cover portion 30. More specifically, and as shown in FIGS. 1 and 4 through 9, cooperative structuring of the connectors 10 in relation to the plurality of frame members 40 allows for each one of the frame members 40 to pass within the first plurality of sockets 21, by insertion through an open end 22' of the elongated grooves 22. The cooperative configuring and dimensioning of the grooves 22 with the interior surface configuration of the respective sockets or slot like structures 21, will serve to grip and more specifically, correctly align and position the frame members 40 in their intended orientation, even prior to the fixed interconnection of the base 20 to the one cover portion 30. Similarly, as shown in FIGS. 4, 5, and 7, any one of the plurality of frame members 40 can be secured within any one of the second plurality of sockets 21', by insertion of the anchor portion 27 into the interior of the elongated grooves 22 formed in the cover portion 30 through the open end of the grooves 22, as at 22'. Again, the cooperative structuring, configuring and dimensioning of each end portion 28 of each of the plurality of frame members 40 will serve to align the respective frame members 40 in their intended orientation, prior to the fixed interconnection of the base 20 and cover portion 30.

As set forth above, and as best shown in FIG. 7, the base 20 of the connector 10 preferably includes a pair of recesses, 26 and 26'. The first recess 26 is preferably disposed, dimensioned and configured to "grip" the extremity 28' of the end portion 28 of the frame member 40 in supportive engagement therewith, once the base 20 and cover portion 30 are interconnected by the fastening structure 50, 51. In addition, the second recess 26' of the recess pair 26, 26' of the base 20 is preferably disposed, dimensioned and configured to receive and grippingly engage a correspondingly positioned segment of the anchor portion 27. Similarly, when a frame member 40 is positioned within any one of the plurality of sockets 21 of base 20, a correspondingly aligned one of the plurality of recesses 26" formed in interior surface 25' of a cover portion 30 is disposed, configured and dimensioned to grippingly engage a protruding segment 27', shown in FIG. 6, of the anchor portion 27, therein. By virtue of the cooperative structuring as set forth above, each end portion 28, by means of the outwardly projecting anchor portion 27, is firmly gripped within the interior of the connector 10 defined by the fixed attachment of a base 20 and one cover portion 30.

Figure 10:
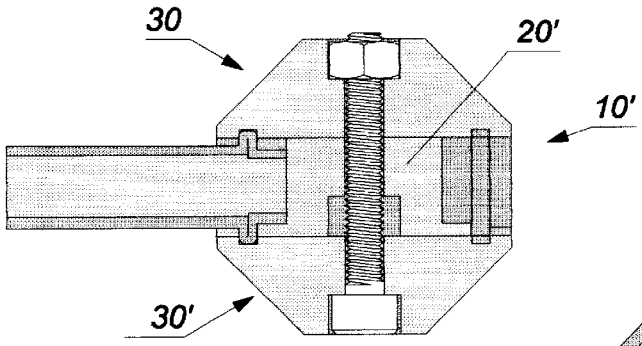
FIG. 10 is a sectional view in assembled form of another preferred embodiment of the present invention.
Figure 11:
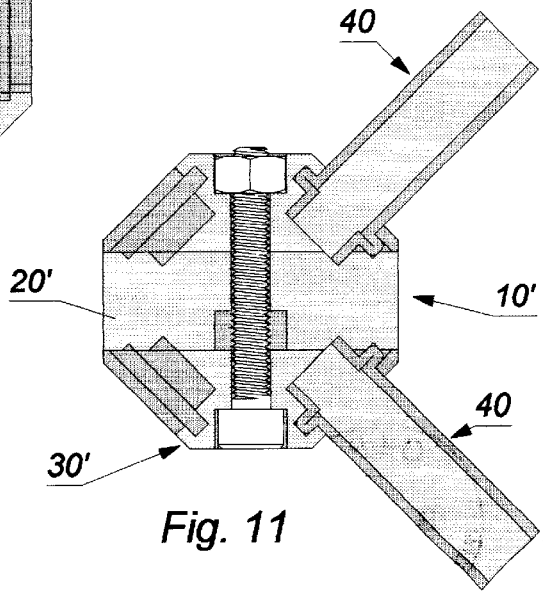
FIG. 11 is a sectional view in assembled form of another orientation of the embodiment of FIG. 10.
Figure 12:
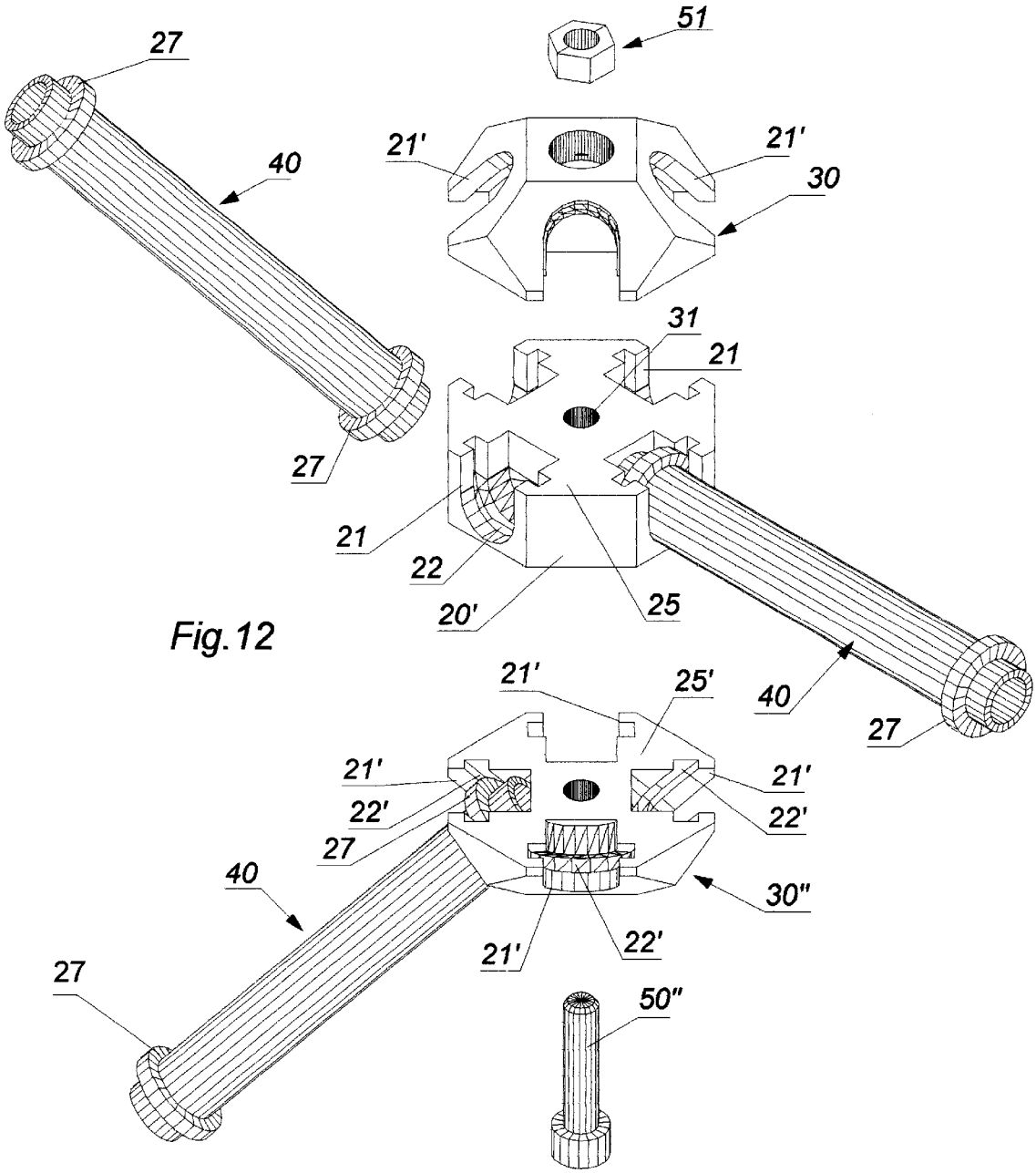
FIG. 12 is an isometric view in exploded form of the embodiment of FIGS. 10 and 11.

With regard to the embodiment of FIGS. 10, 11, and 12, another preferred embodiment of the present invention is illustrated wherein each of a plurality of connectors 10' comprises a second cover portion 30". Preferably, the second cover portion 30" is equivalently structured to the first or at least one cover portion 30, which in the connector 10' illustrated, is connected to an opposite end of the base 20. More specifically, as shown in FIG. 12, a second interior surface 25' of the second, preferably opposite, cover portion is disposed in confronting engagement with the correspondingly positioned interior surface 25" (or undersurface of the base 20, not shown in FIG. 12, but which is shown in FIGS. 3, 6 and 7) of the base 20. As shown in FIGS. 10 and 11, each of the aforementioned components of the connector 10' comprising the base 20, cover portion 30 and an oppositely disposed cover portion 30" are preferably also all connected by a single fastener 50", having a greater longitudinal dimension than the fastener 50, so as to extend co-linear to the central axis of the base 20 and both cover portions 30 and 30". From the drawings illustrating this embodiment, it should be apparent that the attachment of the base 20 with two oppositely disposed cover portions 30 and 30" provides even greater versatility in the geometric arrangement of the various frame members 40, since a plurality of such frame members 40 may extend outward from each of the cover portions 30 and 30", and radially outward in a transverse relation to the central axis of the base 20. It should also be noted in these Figures that each of the plurality of frame members 40 extends transversely outward from either the base 20 or one of the cover portions 30 and/or 30" in a substantially transverse orientation relative thereto. More specifically, each of the frame members 40 is connected to either the base 20 or one of the cover portions 30, 30" at an orientation which is substantially transverse to the sidewall segment from which it extends. Therefore, it should be apparent that each of a plurality of frame members 40 may be disposed in a wide variety of different positions and orientations relative to the connector 10 or 10' to which they are attached. As a result, and as emphasized above, a wide variety of architectural and/or engineering structures incorporating an almost limitless number of repetitive, three dimensional geometric configurations such as those illustrated by way of example only in FIGS. 14A and 14B, may be accomplished. It is also important to note that each of the large variety of structures capable of being formed utilizing the space frame assembly of the present invention offer the highly desirable characteristics of substantial rigidity, significant weight and/or stress bearing capabilities and a light-weight, open construction appearance, as clearly shown.

Figure 14A:
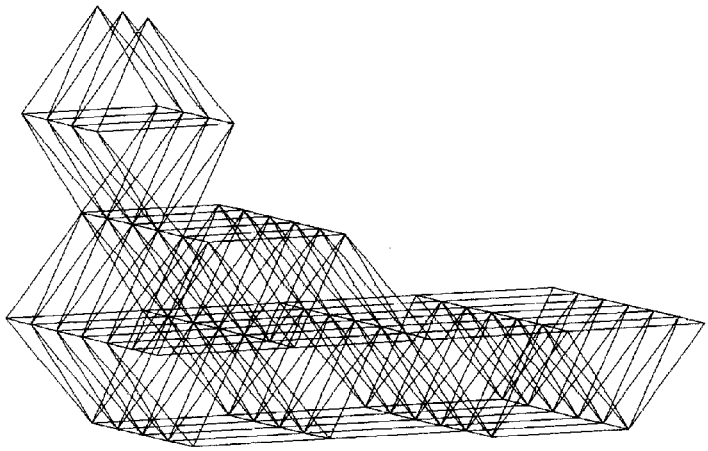
FIG. 14A is an isometric view of an assembled structure formed from the components of the embodiments of FIGS. 1 through 9.
Figure 14B:
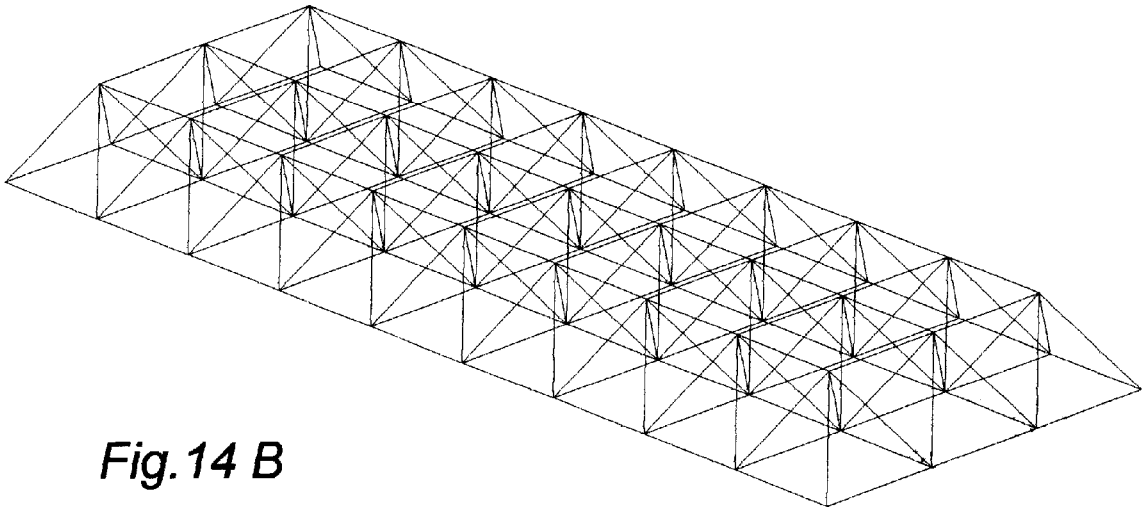
FIG. 14B is an isometric view of another assembled structure formed from the components of the embodiments of FIGS. 1 through 12.

Further, the various orientations at which the plurality of frame members 40 may be arranged relative to one another due to the versatility of the connectors 10 and 10' is further demonstrated in FIG. 13, wherein the plurality of interconnected frame members 40 and connectors 10 are used to form a pyramid configuration 2 which, with additional reference to FIGS. 14A and 14B, is shown as defining at least one primary "building block" of the various structures which may be formed by interconnecting the various components of the space frame assembly of the present invention. The versatility of the space frame assembly of the present invention, including the plurality of equivalently structured frame members 40 and connectors 10, is further demonstrated by the relative positioning of the connectors 10, forming the base of the pyramid 2 being in a substantially upright orientation relative to the position of the pyramid. Also, the connector 10 defining the apex of the pyramid is shown in an inverted configuration. It is pointed out that when forming a more complex, detailed and repetitive three dimensional geometrical configuration of the type shown in FIGS. 14A and 14B, other frame members 40 would be added to the plurality of connectors 10 of the pyramid structure 2.

Figure 15:
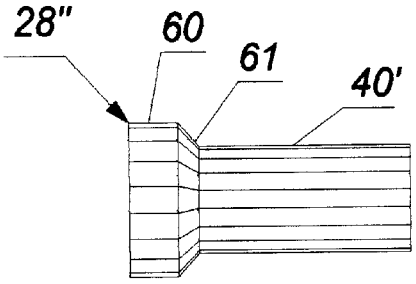
FIG. 15, 16, and 17 are each side views in partial cutaway of different embodiments of anchor portions which may be formed on each of the opposite ends of a frame member component, of the type shown in the embodiments of FIGS. 1 through 12.
Figure 16:
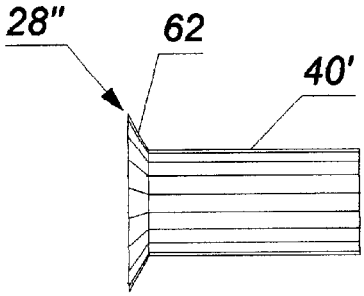
Figure 17:
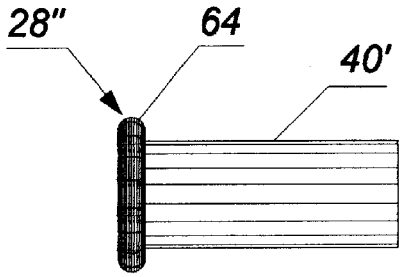

FIGS. 15, 16, and 17 show additional preferred embodiments of the frame members 40. In these embodiments, the end portion, designated as 28", of the respective frame members 40' has been modified. More specifically, FIG. 15 shows a wider, outwardly projected anchor portion 60 located at the extremity of the end portion 28" and being integrally connected to the remainder of the frame member 40' by an inwardly directed, beveled flange 61. With reference to FIG. 16, the end portion 28' is defined by a flange member 62' having an outwardly directed flair, integrally formed on the outer extremity of the end portion 28". FIG. 17 shows yet another preferred embodiment wherein the anchor portion 64 is also integrally formed on the outer extremity of the end portion 28" and comprises a substantially continuous annular configuration.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A space frame assembly designed for use in the construction of a variety of substantially rigid, weight bearing structures, said assembly comprising:

a) a plurality of connectors and a plurality of frame members, said plurality of frame members interconnected to one another by said plurality of connectors, b) said plurality of frame members having an elongated configuration terminating at oppositely disposed end portions, c) each of said end portions dimensioned and configured to be secured to any one of said plurality of connectors, d) each of said plurality of connectors comprising a base portion having a first interior surface and at least one cover portion having a second interior surface, e) said first and second interior surfaces disposed in confronting engagement with one another upon attachment of said base portion to said cover portion, f) a first plurality of sockets integrally formed in said base portion in spaced relation to one another along a sidewall thereof, g) a second plurality of sockets integrally formed in said one cover portion in spaced relation to one another along a sidewall thereof, h) said first and second plurality of sockets disposed in spaced, offset relation to one another and each of said first and second plurality of sockets comprising an open end disposed in confronting relation to said second interior surface and said first interior surface respectively, and i) each of said first and second plurality of sockets disposed and cooperatively structured with any one of said end portions to secure said frame members to any of said plurality of connectors in a transverse, substantially radially outward extending orientation relative to a respective one of said base portion and cover portion to which it is secured.

2. An assembly as recited in claim 1 wherein each of said first plurality of sockets includes a first groove formed therein and dimensioned and configured to receive any one of said end portions therein.

3. An assembly as recited in claim 2 wherein said second interior surface of said one cover portion comprises a plurality of recesses each disposed in aligned relation to one of said first plurality of sockets of said base portion attached thereto.

4. An assembly as recited in claim 3 wherein said correspondingly aligned grooves in said base portion and said plurality of recesses in said second interior surface are cooperatively disposed and structured to grip either of said end portions of any one of said frame members.

5. An assembly as recited in claim 4 wherein each of said end portions includes an anchor portion extending outwardly from said frame member in spaced relation to an outer extremity of a corresponding one said end portions.

6. An assembly as recited in claim 5 wherein said first groove of each of said first plurality of sockets and a correspondingly aligned recess are collectively disposed and dimensioned to receive said anchor portion therein.

7. An assembly as recited in claim 5 wherein each of said first plurality of grooves includes an aperture formed therein, said aperture disposed and dimensioned to allow protrusion of said anchor portion therethrough.

8. An assembly as recited in claim 2 wherein each of said second plurality of sockets includes a second groove formed therein and dimensioned and configured to receive either of said end portions therein.

9. An assembly as recited in claim 8 wherein said first interior surface of said base comprises a plurality of recesses each disposed in aligned relation to one of said second plurality of sockets of said one cover portion attached thereto.

10. An assembly as recited in claim 9 wherein correspondingly aligned second grooves in said one cover portion and said plurality of recesses in said first interior surface are cooperatively disposed and structured to grip said end portion.

11. An assembly as recited in claim 10 wherein each of said end portions includes an anchor portion extending outwardly from said frame member in spaced relation to an outer extremity of said end portion.

12. An assembly as recited in claim 11 wherein said second grooves and correspondingly aligned recesses in said first interior surface are collectively disposed and dimensioned to receive said anchor portion therein.

13. An assembly as recited in claim 12 wherein said first interior surface comprises a plurality of recess pairs, each recess pair disposed in aligned relation to one of said second plurality of sockets of said one cover portion.

14. An assembly as recited in claim 13 wherein a first recess of each recess pair is disposed and configured to receive an outer extremity of said end portion and a second recess of each recess pair is disposed and configured to receive said anchor portion.

15. An assembly as recited in claim 1 wherein each of said end portions of said plurality of frame members comprises an outwardly projecting anchor portion cooperatively dimensioned and configured for gripped attachment within any one of said first and second plurality of sockets.

16. An assembly as recited in claim 15 wherein each of said first and second plurality of sockets comprises an elongated groove formed therein and cooperatively configured to receive at least the majority of said anchor portion of any one of said plurality of frame members therein.

17. An assembly as recited in claim 16 wherein said second interior surface comprises a plurality of recesses formed therein, each of said plurality of recesses disposed in aligned relation with one of said first plurality of sockets through a correspondingly open end of each of said plurality of sockets; each of said plurality of recesses further disposed in cooperatively aligned relation with said groove of a corresponding one of said first plurality of sockets in a manner to receive said anchor portion of any one of said frame members therein.

18. An assembly as recited in claim 17 wherein said first interior surface comprises a plurality of recess pairs formed therein in aligned relation with one of said second plurality of sockets through a corresponding open end of each of said second plurality of sockets.

19. An assembly as recited in claim 18 wherein a first recess of each recess pair is disposed and configured to receive an outer extremity of said end portion of any one of said frame members and a second recess of said recess pair is disposed and configured to receive said anchor portion therein.

20. A space frame assembly designed for use in the construction of a variety of substantially rigid, weight bearing structures, said assembly comprising:

a) a plurality of connectors and a plurality of frame members, said plurality of frame members interconnected to one another by said plurality if connectors, b) said plurality of frame members having an elongated configuration terminating at oppositely disposed end portions, c) each of said end portions dimensioned and configured to be secured to any one of said plurality of connectors, d) each of said plurality of connectors comprising a base portion having two spaced apart first interior surfaces and two cover portions each having a second interior surface, e) each of said first interior surfaces disposed in confronting engagement with said second interior surface of a different one of said two cover portions upon attachment of said base portion to said two cover portions, f) a first plurality of sockets each including an open end and being integrally formed in said base portion in spaced relation to one another along a sidewall thereof, g) a second plurality of sockets each including an open end and being integrally formed in each of said cover portions in spaced relation to one another along a respective sidewall thereof, h) each open end of said first plurality of sockets disposed in confronting relation to said second interior surface of one of said cover portions and each open end of said second plurality of sockets disposed in confronting relation to one of said first interior surfaces of said base portion, and i) each of said first and second plurality of sockets disposed and cooperatively structured with any one of said end portions to secure said frame members to any one of said plurality of connectors in a transverse, substantially radially outward extending orientation relative to a respective one of said base portion and said two cover portions to which it is secured.

21. An assembly as recited in claim 20 wherein each of said first plurality of sockets includes a first groove formed therein and dimensioned and configured to receive any one of said end portions therein; said second interior surface of at least one of said two cover portions comprising a plurality of recesses each of which is disposed in aligned relation to one of said first plurality of sockets in said base portion being attached thereto.

22. An assembly as recited in claim 21 wherein said correspondingly aligned grooves in said base portion and said plurality of recesses in said second interior surface of at least one of said cover portions are cooperatively disposed and structured to grip either of said end portions of any one of said frame members.

23. An assembly as recited in claim 22 wherein each of said end portions includes an anchor portion extending outwardly from said frame member in spaced relation to an outer extremity of a corresponding one of said end portions; said first groove of each of said first plurality of sockets and a correspondingly aligned recess of one of said two second interior surfaces are collectively disposed and dimensioned to receive said anchor portion therein.

24. An assembly as recited in claim 23 wherein each of said first plurality of grooves includes an aperture formed therein, said aperture disposed and dimensioned to allow protrusion of said anchor portion therethrough.

25. An assembly as recited in claim 20 wherein each of said plurality of frame members connected to said base portion are disposed in substantially co-planer relation to one another; each of said plurality of frame members connected to each of said cover portions disposed in angular orientation relative to said plurality of frame members connected to said base portion.

26. A space frame assembly designed for use in the construction of of a variety of substantially rigid, weight bearing structures, said assembly comprising:

a) a plurality of connectors and a plurality of frame members, said plurality of frame members interconnected to one another by said plurality of connectors, b) said plurality of frame members having an elongated configuration terminating at oppositely disposed end portions, c) each of said end portions dimensioned and configured to be secured to any one of said plurality of connectors, d) each of said plurality of connectors comprising a base portion having a first interior surface and at least one cover portion having a second interior surface.

e) said first and second interior surfaces disposed in confronting engagement with one another upon attachment of said base portion to said cover portion, f) a first plurality of sockets integrally formed in said based portion in spaced relation to one another along a side wall thereof, g) a second plurality of sockets integrally formed in said one cover portion in spaced relation to one another along a side wall thereof, h) said second interior surface disposed in confronting relation to said first plurality of sockets and in retaining engagement with said end portions disposed within said first plurality of sockets, and i) each of said first and second plurality of sockets disposed and cooperatively structured with any one of said end portions to secure said frame members to any of said plurality of connectors in a transverse, substantially radially outward extending orientation relative to a respective one of said base portion and cover portion to which it is secured.

27. An assembly as recited in claim 26 wherein said second interior surface of said one cover portion comprises a plurality of recesses formed therein, each of said recesses disposed in receiving, retaining engagement with one of said end portions disposed within said first plurality of sockets of said base portion attached to said one cover portion.

28. An assembly as recited in claim 26 wherein said first interior surface is disposed in confronting relation to said second plurality of sockets and in retaining engagement with said end portions disposed within said second plurality of sockets.

* * * * *